US006020100A

United States Patent [19]

Iwasaki et al.

[11] Patent Number: 6,020,100

[45] Date of Patent: Feb. 1, 2000

[54] COLOR TONER MANUFACTURING METHOD, COLOR TONER MASTER BATCH, AND COLOR TONER

[75] Inventors: Yoshiaki Iwasaki, Toyonaka; Koshiro Nakao, Nishinomiya; Hiroshi Nakamura, Kobe; Shigeyuki Hakumoto, Toyonaka, all of Japan

[73] Assignee: Minolta Co., Ltd., Osaka, Japan

[21] Appl. No.: 09/045,376

[22] Filed: Mar. 20, 1998

[30] Foreign Application Priority Data

| | | | |
|---|---|---|---|
| Mar. 21, 1997 | [JP] | Japan | 9-067861 |
| Mar. 21, 1997 | [JP] | Japan | 9-067862 |
| Mar. 21, 1997 | [JP] | Japan | 9-067863 |
| Mar. 21, 1997 | [JP] | Japan | 9-067864 |

[51] Int. Cl.[7] ..... G03G 9/08

[52] U.S. Cl. ..... 430/106; 430/137

[58] Field of Search ..... 430/106, 109, 430/137

[56] References Cited

U.S. PATENT DOCUMENTS

| | | | |
|---|---|---|---|
| 5,272,034 | 12/1993 | Kawano et al. | 430/137 |
| 5,300,383 | 4/1994 | Tsubota et al. | 430/45 |
| 5,863,692 | 1/1999 | Nakamura et al. | 430/137 |

FOREIGN PATENT DOCUMENTS

| | | |
|---|---|---|
| 62-030259 | 9/1987 | Japan . |

*Primary Examiner*—John Goodrow
*Attorney, Agent, or Firm*—McDermott, Will & Emery

[57] ABSTRACT

A method of producing a color toner whereby a binder resin, a chromatic coloring material and a metal oxide particulate material are mixed to obtain a first mixture. Thereafter, a second mixture is obtained by mixing the first mixture with a material other than the materials used to obtain the first mixture. The second mixture is melted, kneaded, cooled and pulverized.

25 Claims, 1 Drawing Sheet

COLOR TONER MANUFACTURING METHOD, COLOR TONER MASTER BATCH, AND COLOR TONER

RELATED APPLICATIONS

The present invention is based on Japanese Patent Application Nos. 9-67,861, 9-67,862, 9-67,863 and 9-67,864, each content of which is incorporated herein by reference.

FIELD OF THE INVENTION

The present invention relates to a method of manufacturing color toners for use in full color image forming apparatuses, such as full color electrostatic copying machine and full color laser beam printer, color toner master batch, and color toner.

BACKGROUND OF THE INVENTION

In a conventional image forming method which has been widely employed in copying machines, printers, facsimile, and the like, an electrostatic latent image formed on an electrostatic latent image supporting member, such as a photosensitive member, is developed by a toner, and the resulting toner image is transferred onto a recording member, such as recording paper, for image formation. In recent years, a full-color image forming apparatus for reproducing a multicolor image by superposing plural colors one over another has been put in practical application.

In such a full-color image forming apparatus, an electrostatic image is formed in dot units on an organic photosensitive member which is negatively charged by digital writing, for example, light beam irradiation, and the latent image is developed in reverse by using negatively chargeable magenta, cyan, and yellow toners, and black toner as required. Toner images of different colors thus obtained are superposed one over another so as to be reproduced as a multicolor image.

Such full-color image formation is largely utilized in reproducing pictures, photographs, graphic images and, as mentioned above, color toners of plural colors are superposed one over another for multicolor image reproduction. Such multicolor imaging is widely employed not only for image formation on recording paper, but also for image formation on overhead projector transparent sheets (OHP sheet). However, even though the color toner has distinct color reproducibility when a color toner image is formed on the recording paper, there is a problem that if such an image, formed on an OHP sheet, is actually projected onto a screen, the image becomes somewhat blackish, thus showing reduced color reproducibility.

SUMMARY OF THE INVENTION

It is an object of the present invention to provide a method of producing a color toner having good color developing characteristics and transparency when image formation is made on any recording paper or on any OHP sheet.

It is another object of the invention to provide a color toner master batch having good color developing characteristics and transparency when image formation is made on any recording paper or on any OHP sheet.

It is another object of the invention to provide a color toner having good color developing characteristics and transparency when image formation is made on any recording paper or on any OHP sheet.

The present invention relates to a method of producing a color toner which comprises the following steps:

a first mixing step for mixing a binder resin, a chromatic coloring material, and metal oxide particulate, wherein the weight ratio of the chromatic coloring material to the metal oxide particulate is 10:1–1:5;

a second mixing step for mixing the mixture obtained at the first mixing step and a material other than the materials used in the first mixing step;

the step of melting and kneading the mixture obtained at the second mixing step;

the step of pulverizing the kneaded mixture after the mixture has been cooled; and the step of classifying the resulting pulverized material.

The present invention further relates to a method of producing a color toner which comprises the following steps:

a first mixing step for mixing a binder resin having a mean particle size of 1 to 3 mm, and a chromatic coloring material;

a second mixing step for mixing the mixture obtained at the first mixing step and a binder resin having a mean particle size of 0.1 to 0.5 mm;

the step of melting and kneading the mixture obtained at the second mixing step;

the step of pulverizing the kneaded mixture after the mixture is cooled; and the step of classifying the resulting pulverized material.

The present invention further relates to a master batch for use in a color toner comprising:

a binder resin, 20 to 100 parts by weight of a chromatic coloring material relative to 100 parts by weight of the binder resin, and metal oxide particulate.

The present invention further relates to a method of producing a color toner which comprises the following steps:

a master batch preparing step for preparing a master batch containing a binder resin, 20 to 100 parts by weight of a chromatic coloring agent relative to 100 parts by weight of the binder resin, and metal oxide particulate;

a first mixing step for mixing the master batch and a binder resin;

a second mixing step for mixing the mixture obtained at the first mixing step and a material other than the materials used in the first mixing step;

the step of melting and kneading the mixture obtained;

the step of pulverizing the kneaded mixture after the mixture is cooled; and the step of classifying the resulting pulverized material.

The present invention further relates to a magenta toner comprising:

at least a binder resin and a magenta pigment; wherein when a film of the magenta toner is formed on a sheet for an overhead projector, the toner film has a surface gloss of 105 or more and satisfies the following relation (1):

$$(A_{MP}-A_{MB})/A_{MB} \geqq 85 \quad (1)$$

in which $A_{MP}$ denotes maximum absorbance of the toner film in a wave range of 500 to 600 nm, and $A_{MB}$ denotes minimum absorbance in a wave range of 400 to 800 nm.

The present invention further relates to a yellow toner comprising:

at least a binder resin and a yellow pigment; wherein when a film of the yellow toner is formed on a sheet for an overhead projector, the toner film has a surface gloss of 105 or more and satisfies the following relation (2):

$$(A_{YP}-A_{YB})/A_{YB} \geqq 75 \quad (2)$$

in which $A_{YP}$ denotes maximum absorbance of the toner film in a wave range of 380 to 500 nm, and $A_{YB}$ denotes minimum absorbance in a wave range of 400 to 800 nm.

The present invention further relates to a cyan toner comprising:

at least a binder resin and a cyan pigment; wherein when a film of the cyan toner is formed on a sheet for an overhead projector, the toner film has a surface gloss of 105 or more and satisfies the following relation (3):

$$(A_{CP}-A_{CB})/A_{CB} \geqq 45 \quad (3)$$

in which $A_{CP}$ denotes maximum absorbance of the toner film in a wave range of 600 to 800 nm, and $A_{CB}$ denotes minimum absorbance in a wave range of 400 to 800 nm.

DESCRIPTION OF THE PREFERRED EMBODIMENTS

Figure 1:
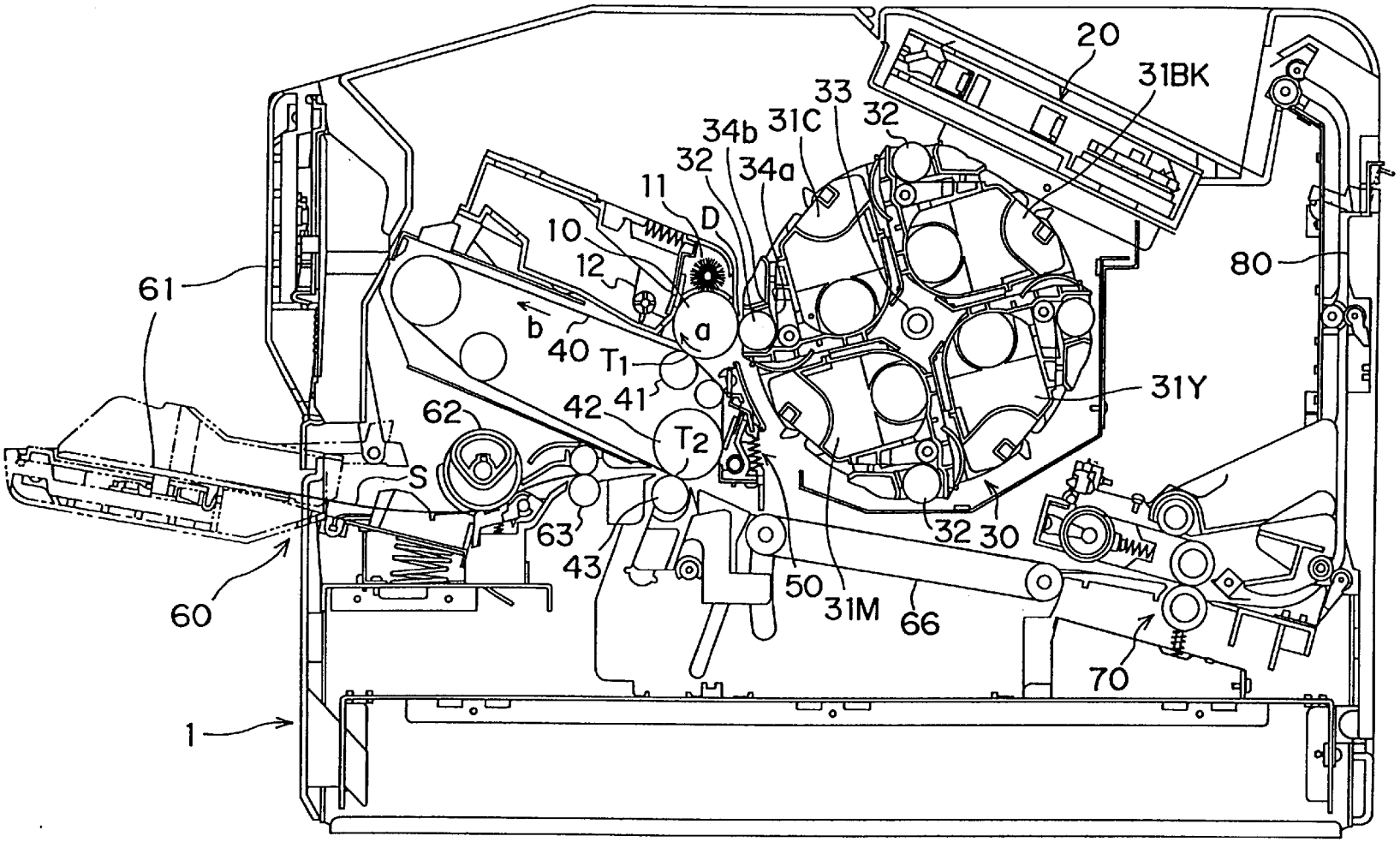
FIG. 1 is a view showing schematic construction of a full-color printer.

The method of producing a toner according to a first embodiment of the present invention is a mixing and pulverizing method for producing toner particles through steps of material-mixing, melting and kneading, pulverizing, and classifying. In the method, as will be explained hereinafter, the step of material mixing is carried out at plural stages, whereby dispersion characteristic of the chromatic coloring material can be improved, and this in turn results in improved color developing performance and improved transparency. The chromatic coloring material is usually obtainable in the form of fine primary particles during the process of synthesis thereof. However, when the coloring material is dried, secondary agglomeration occurs with the result that particles would become agglomerates having a volume mean particle size of 2 to 10 $\mu$m. If a coloring material in the form of such secondary agglomerates is used, mere application of conventional mixing and grinding technique is not sufficient to cause the coloring material to be minutely dispersed into the toner, because the chromatic coloring material has high cohesive force. Therefore, the step of material mixing is divided into multiple stages to enable particular materials to be sequentially mixed so that dispersion of the coloring material in the form of secondary aggregation can be enhanced.

First, a binder resin, a chromatic coloring material, and metal oxide particles are mixed together at a first mixing step. At a second mixing step, a material other than the materials used in the first mixing step, such as a charge control agent and wax is introduced into and mixed with the mixture obtained at the first mixing step. In the case where dust size toner fine particles produced at pulverizing and classifying steps to be described hereinafter is to be collected and recycled as a material for toner production, such collected toner particles are introduced into and mixed with the mixture obtained at the second mixing step. At the first mixing step, coarse particles of binder resin having a volume mean particle size of 0.1 to 2 mm are used and a mixing operation is carried out by employing a mixing apparatus, such as Henschel mixer, which can exert shearing force upon the materials being mixed. By carrying out mixing in such a way, the secondary agglomerates of the coloring material are finely disintegrated into primary particles under a stress exerted when coarse particles of binder resin are mixed while being ground. Further, the introduction of metal oxide fine particles results in the deposition of the metal oxide fine particles on the disintegrated coloring material, so that the chromatic coloring material which has been disintegrated into primary particles is prevented from becoming re-agglomerated. Further, because of the fact that such particulate material as charge control agent or collected dust-size toner particles is not introduced at the first mixing step, the shear force to be exerted on secondary agglomerates of the coloring material will not be lowered. Therefore, the secondary agglomerates can be effectively reduced to minute particle size. At the first mixing step, the chromatic coloring material and the metal oxide particulate are added in a weight ratio of chromatic coloring material to metal oxide particulate, of from 10:1 to 1:5, preferably 5:1 to 1:5. If the proportion of the metal oxide particulate is too small, no sufficient effect of such particulate could be obtained for the prevention of re-agglomeration of the chromatic coloring material and for improvement of the surface smoothness of toner-fixed film, and this results in degradation in color reproducibility and transparency. If the proportion of the metal oxide particulate is too large, the effect of glare prevention by the metal oxide particulate is excessively pronounced, so that the transparency of the toner is adversely affected.

For the metal oxide particulate it is desirable to use particles having a BET specific area of 20 to 300 $m^2/g$, preferably 30 to 250 $m^2/g$. As such metal oxide fine particles is it necessary to use colorless or white color particles, which will not affect the color reproducibility of the color toner, including for example silicon oxide (silica), titanium dioxide (titania), aluminum oxide (alumina), tin oxide, zinc oxide, and calcium oxide. From the viewpoint of environmental stability of the toner, for such metal oxide particulate, it is desirable to use hydrophobic particles which are surface-treated with a hydrophobicizing agent.

The chromatic coloring material and metal oxide fine particles only may be pre-mixed prior to the first mixing step. By carrying out such a pre-mixing step it is possible to efficiently cause metal oxide fine particles to deposit on the surface of the disintegrated chromatic coloring material to thereby prevent the re-agglomeration of chromatic coloring material particles during the process of toner preparation.

Next, as the second mixing step, a material other than the materials used in the first mixing step, such as a charge control agent and, where necessary, other material such as wax are introduced into and mixed with the mixture obtained at the first mixing step. In the case where collected dust-size toner particles are used as a material for toner preparation, such toner particles are introduced at the third mixing step, because the introduction of such particles at the second mixing step would lower the dispersibility of the charge control agent and the like.

By carrying out toner preparation in such a way it is possible to achieve minute dispersion of the coloring material without any such pretreatment as flush treatment of the chromatic coloring material or master batch treatment, to thereby reduce the cost of toner preparation.

According to the first embodiment described above, a toner having a volume-mean particle size of 4 to 9 $\mu$m, with the chromatic coloring material minutely dispersed therein, can be obtained through the steps of melting and kneading the mixture obtained in the above multiple stage mixing, pulverizing the kneaded mixture after the mixture having been cooled, and classifying the resulting pulverized particles. The toner thus obtained has improved dispersion of the chromatic coloring material, high transparency and good color reproducibility.

The method of producing a toner according to a second embodiment of the present invention is a mixing and pulverizing method for producing toner particles through steps of material mixing, melting and kneading, pulverizing, and classifying. In the method, as will be explained hereinafter, the step of material mixing is carried out at plural stages, whereby dispersion characteristic of the chromatic coloring material can be improved, and this in turn results in improved color developing performance and improved transparency.

First, a binder resin having a mean particle size of 1 to 3 mm, and a chromatic coloring material only are mixed at a first mixing step. A mixing operation is carried out by employing a mixing apparatus, such as Henschel mixer, which can exert shearing force upon the materials being mixed. Where binder resin particles having such a large particle size are mixed with the coloring material, particles of the coloring material which have become secondarily agglomerated are promptly disintegrated since the large-size binder resin particles exert a large amount of energy upon impingement thereof against the coloring material. However, once particles of the coloring material have been disintegrated to a certain extent, the coloring material will not become smaller in particle size any further. Whilst, where resin particles of small particle size and the coloring material are mixed together, it takes time to disintegrate the coloring material which has been secondarily agglomerated, because the impinging energy which will act on the coloring material is rather small. In this case,however, the coloring material can be more minutely disintegrated than in the case where resin particles of large particle size are used. From this point of view, at a second mixing step, the mixture obtained at the first mixing step using larger-size resin particles is admixed with smaller size resin particles having a mean particle size of 0.1 to 0.5 mm. Through the provision of this second mixing step the coloring material can be more finely disintegrated. At the second mixing step, materials other than those mixed at the first mixing step, for example, charge control agent and wax, may be introduced along with small-size resin particles for being mixed together. Further, it maybe so arranged that at the second mixing step, small-size resin particles only are introduced into and mixed with the mixture obtained at the first mixing step, and that at a third mixing step, other material is introduced into the resulting mixture for being mixed therewith. By so doing it is possible to enhance the dispersion of the coloring material so that the resulting toner has improved color reproducibility.

Where dust-size toner particles produced at the pulverizing and classifying steps are collected and recycled as material for toner production, the collected toner particles may be introduced into and mixed with the mixture obtained through the above described mixing steps.

By carrying out toner preparation in such a way it is possible to achieve minute dispersion of the coloring material without any such pretreatment as flush treatment of the chromatic coloring material or master batch treatment, to thereby reduce the cost of toner preparation.

According to the second embodiment described above, a toner having a volume-mean particle size of 4 to 9 $\mu$m, with the chromatic coloring material minutely dispersed therein, can be obtained after the steps of melting and kneading a mixture obtained through multiple stage mixing, pulverizing the kneaded mixture after the mixture having been cooled, and classifying the resulting pulverized particles. The toner thus obtained has improved dispersion of the chromatic coloring material, high transparency and good color reproducibility.

A color toner master batch according to a third embodiment of the invention contains a high-concentration chromatic coloring material, a binder resin, and metal oxide particulate. By blending metal oxide particulate in this way it is possible to enhance the dispersion of the chromatic coloring material and improve toner transparency. Conceivably, the reason for the improvement in the dispersion of the coloring material may be explained by the fact that metal oxide particles deposit on particles of the disintegrated chromatic coloring material, which in effect prevents re-agglomeration of the chromatic coloring material. The reason for the improvement in transparency may be that the metal oxide particles serve to smooth the surface of a toner image after fixation, with the result that the possibility of irregular reflection on an image surface is reduced, which in effect leads to improved transparency. For the metal oxide particulate, particles similar to those used in the first embodiment may be used.

According to the third embodiment of the invention, a master batch is obtained by first mixing the materials, then melting and kneading the mixture, and pulverizing the kneaded mixture after having been cooled. More specifically, first, the chromatic coloring material, binder resin, and metal oxide fine particles are mixed together by a mixing apparatus, such as Henschel mixer, which can exert shearing force upon the materials being mixed. At this mixing step, disintegration of secondary agglomerates of chromatic coloring material occurs under a stress due to the shearing force of the mixer. In this conjunction, it may be arranged that prior to the mixing step, the chromatic coloring material and the metal oxide particulate are mixed and disintegrated and thereafter the mixture and the binder resin are mixed together. by so doing it is possible to further enhance the dispersion of the chromatic coloring material.

Then, the mixture is melted and kneaded, and the kneaded mixture is pulverized after having been cooled. The master batch is thus obtained. At this melting and kneading step, the coloring material is subjected to a large shearing force due to the high concentration of chromatic coloring material in the kneaded mixture, so that the coloring material is minutely dispersed.

The chromatic coloring material content of the master batch is 20 to 100 parts by weight, preferably 30 to 50 parts by weight, relative to 100 parts by weight of the binder resin. The weight ratio of the chromatic coloring material to the metal oxide particulate (coloring material: metal oxide) in the master batch is from 10:1 to 1:5, preferably from 5:1 to 1:5.

Then, the binder resin and, where necessary, additives, such as charge control agent and wax, are introduced into the master batch for being mixed therewith. The amount of addition of the binder resin to the master batch is so arranged that the coloring material content of the color toner finally obtained is 1 to 10 parts by weight relative to 100 parts by weight of the binder resin. A color toner having a volume-mean particle size of 4 to 9 $\mu$m, with the chromatic coloring material minutely dispersed therein, can be obtained after the steps of melting and kneading the mixture obtained, pulverizing the kneaded mixture after the mixture having been cooled, and classifying the resulting pulverized particles. The color toner thus obtained has improved dispersion of the chromatic coloring material, high transparency and good color reproducibility.

In conjunction with the present invention, it has been found that the color reproducibility of color toner on an OHP sheet is dependent on the surface gloss of a toner film formed on the OHP sheet and, in turn, on the relation between maximum absorbance in a complementary wave range of the toner film and minimum absorbance (background absorbance) in a visible light range (400 to 800 nm). The degree of such dependence varies from color to color among different color toners and, therefore, color toners are prepared with adjustment within a specified range for each respective color toner, whereby good color reproduction on the OHP sheet can be achieved.

More specifically, in a magenta toner containing at least a binder resin and a magenta pigment, when a film of the magenta toner is formed on a sheet for an overhead projector, the toner film has a surface gloss of 105 or more and satisfies the following relation (1):

$$(A_{MP}-A_{MB})/A_{MB} \geqq 85 \quad (1)$$

in which $A_{MP}$ denotes maximum absorbance of the toner film in a wave range of 500 to 600 nm, and $A_{MB}$ denotes minimum absorbance in a wave range of 400 to 800 nm.

In a yellow toner containing at least a binder resin and a yellow pigment, when a film of the yellow toner is formed on a sheet for an overhead projector, the toner film has a surface gloss of 105 or more and satisfies the following relation (2):

$$(A_{YP}-A_{YB})/A_{YB} \geqq 75 \quad (3)$$

in which $A_{YP}$ denotes maximum absorbance of the toner film in a wave range of 380 to 500 nm, and $A_{YB}$ denotes minimum absorbance in a wave range of 400 to 800 nm.

In a cyan toner containing at least a binder resin and a cyan pigment, when a film of the cyan toner is formed on a sheet for an overhead projector, the toner film has a surface gloss of 105 or more and satisfies the following relation (3):

$$(A_{CP}-A_{CB})/A_{CB} \geqq 45 \quad (3)$$

in which $A_{CP}$ denotes maximum absorbance of the toner film in a wave range of 600 to 800 nm, and $A_{CB}$ denotes minimum absorbance in a wave range of 400 to 800 nm.

The magenta toner to be used in the invention is such that the surface gloss of a magenta toner film formed on an OHP sheet is 105 or more. If the surface gloss is less than 105, transmitted light is reduced under the effect of irregular reflection on the surface of the toner layer, with the result that image transparency is reduced. While there is no particular upper limit of surface gloss, it is desirable that the surface gloss is less than 200, preferably about 150. Above noted values for the surface gloss are values measured according to the following method. First, an organic solvent solution with a toner dissolved therein was coated on an OHP sheet by a bar coat method so as to give a predetermined film thickness after dried. The glossiness of the toner film thus obtained was measured by using a gloss meter (GM-060; made by Minolta K. K). The glossiness was calculated from the relation: (reflected luminous flux from sample/reflected luminous flux from standard glass)×100. Measurement was made under the following conditions: angle of incidence and reflection of measured light was fixed at 60°; and glossiness of the standard glass having a refractive index of 1.567 was taken as 100. A magenta toner having above mentioned surface glossiness has good levelling characteristic such that its surface becomes smooth when the toner, melted at the stage of heat fixation, gets solidified.

In the magenta toner of the invention, the value of $(A_{MP}-A_{MB})/A_{MB}$ in the above noted relation (1) is 85 or more, preferably 90 or more, more preferably 100 or more. If the value is less than 85, the transparency and color developing characteristic of the magenta toner on the OHP sheet will be lowered. There is no particular need for setting an upper limit for the value, though theoretically it is desirable that the value is larger. However, in view of the fact that above mentioned characteristic would become visually saturated and from the view point of the cost required for enhancement of dispersion, it is desirable that the value be not more than 500, preferably not more than 300. It is to be noted that the value has a correlation with the dispersion of the coloring material in the toner such that the value tends to become larger as dispersed particles of the coloring material are reduced in size. Aforesaid absorbance values are based on measurements made by using a self-recording spectro-photometer (U-3200; made by Hitachi Seisakusho K. K.) with respect to spectroscopic absorbance of toner films formed on the OHP sheet in a wave range of 400 to 800 nm.

In the present invention, the yellow toner to be used is such that the surface gloss of a yellow toner film formed on an OHP sheet is 105 or more. If the surface gloss is less than 105, transmitted light is reduced under the effect of irregular reflection on the surface of the toner layer, with the result that image transparency is reduced.

In the yellow toner of the invention, the value of $(A_{YP}-A_{YB})/A_{YB}$ in the above noted relation (2) is 75 or more, preferably 80 or more, more preferably 85 or more. If the value is less than 75, the transparency and color developing characteristic of the yellow toner on the OHP sheet will be lowered. There is no particular need for setting an upper limit for the value, though theoretically it is desirable that the value is larger. However, in view of the fact that above mentioned characteristic would become visually saturated and from the view point of the cost required for enhancement of dispersion, it is desirable that the value be not more than 500, preferably not more than 300.

In the present invention, the cyan toner to be used is such that the surface gloss of a cyan toner film formed on an OHP sheet is 105 or more. If the surface gloss is less than 105, transmitted light is reduced under the effect of irregular reflection on the surface of the toner layer, with the result that image transparency is reduced.

In the cyan toner of the invention, the value of $(A_{CP}-A_{CB})/A_{CB}$ in the above noted relation (3) is 45 or more, preferably 50 or more, more preferably 55 or more. If the value is less than 45, the transparency and color developing characteristic of the cyan toner on the OHP sheet will be lowered. There is no particular need for setting an upper limit for the value, though theoretically it is desirable that the value is larger. However, in view of the fact that above mentioned characteristic would become visually saturated and from the view point of the cost required for enhancement of dispersion, it is desirable that the value be not more than 500, preferably not more than 300.

For the chromatic coloring material in the invention, various known dyes and pigments may be used including, but not limited to, magenta colorants, such as C. I. pigment red 1–19, 21–23, 30–32, 37–41, 48–55, 57, 63, 64, 68, 81, 83, 87–90, 112, 114, 122, 123, 163, 184, 202, 206, 207 and 209; yellow colorants, such as C. I. pigment yellow 1–7, 10–17, 23, 65, 73, 83 and 180, C. I. bat yellow 1, 3 and 20; and cyan colorants, such as C. I. pigment blue 2, 3, and 15–17. The chromatic coloring material content of the toner is 1 to 15 parts by weight, preferably 1 to 10 parts by weight, relative to 100 parts by weight of the binder resin.

For the binder resin in the color toner of the present invention, it is desirable to use a resin having particular melting characteristics so as to enable the toner, as a full color toner, to have good light transmission property and good color reproducibility. It is desirable that the binder resin should have a melting viscosity $V_2$ at 100° C. of $5\times10^4$ to $1\times10^6$ poise, and that the ratio of melting viscosity $V_1$ of the binder resin at 90° C. to the melting viscosity $V_2$ ($V_1/V_2$) should be 8 or more, preferably from 8 to 40. If $V_1/V_2$ is less than 8, the surface smoothness of the image is unfavorably affected with the result that the image surface tends to cause irregular reflection. Further, from the standpoint of fixation, it is desirable to use a binder resin having a softening point of 90 to 115° C. As long as the binder resin has such characteristics, the resin can be used in the present invention irrespective of the kind of the resin. Examples of such resins include styrene-acrylic copolymer resins, polyester resins, and epoxy resins, which may be used in one kind alone or in combination of two or more kinds. Of these resins, polyester resins are particularly preferred.

In the present invention, a preferred polyester resin is a polycondensation product comprising an alcoholic component, mainly bisphenol A alkylene oxide adduct, and an acid component including a phthalo-dicarboxylic acid or a combination of a phthalo-dicarboxylic acid and a fatty dicarboxylic acid.

For the charge control agent, it is necessary to use a colorless, white or light-colored agent serving as such. Examples of such agent include chrome salicylate complex salt E-81, 82 (made by Orient Kagaku Kogyo K. K.), zinc salicylate complex salt E-84 (made by Orient kagaku Kogyo K. K.), aluminum salicylate complex salt E-86 (made by Orient Kagaku Kogyo K. K.), calix arene compound E-89 (made by Orient Kagaku Kogyo K. K.), and boron benzylate complex salt.

Where necessary, waxes such as low molecular weight polypropylene wax, low molecular weight polyethylene wax, carnauba wax, and SASOL wax may be added for anti-offset property improvement and, in the case of non-magnetic one-component toner, for preventing toner deposition on the regulator blade and/or developing roller of the developing apparatus.

In the present invention, 0.2 to 3 % by weight of inorganic fine particles may be externally added to the toner particles obtained through above described steps for adjustment of fluidity and/or chargeability of the toner. Examples of such inorganic fine particles are silica, titania, alumina, strontium titanate, and tin oxide, which may be used in one kind alone or in a mixture of two or more kinds. From the viewpoint of environmental stability improvement it is desirable to use inorganic fine particles which have been surface treated with a hydrophobicizing agent. Besides such inorganic oxide particles, fine resin particles having a particle size of not more than 1 μm may be externally added for cleanability improvement.

The color toner of the present invention can be used as a two-component developer non-magnetic toner which is to be used in mixture with a carrier, or as a non-magnetic one component toner which is not to be used with a carrier.

EXAMPLES

The invention will now be described in further detail with respect to several examples given below. It is to be understood, however, that the invention is in no way limited by these examples. The binder resin used in the following examples and comparative examples is a polyester resin A obtained from bisphenol A propylene oxide adduct/bisphenol A ethylene oxide adduct/terephthalic acid. The polyester resin A has a softening point of 98° C. and a glass transition point of 62° C. The melting viscosity at 100° C. of the binder resin is $1\times10^5$ poise, and the ratio of the melting viscosity at 90° C. to the melting viscosity at 100° C. is 9. In Examples 1 to 7 and Comparative Examples 1 to 6, a polyester resin A in the form of particles pulverized to a volume-mean particle size of about 0.8 mm was used as such.

For the softening point and melting viscosity, measurement was made with respect to 1.0 g of sample by using a flow tester (CFT-500; made by Shimadzu Seisakusho K. K.) and a die of 1.0 mm×1.0 mm under the conditions: temperature rise, 3.0° C./min.; preheat time, 180 sec.; load applied, 30 kg; measurement temperature range, 60 to 140° C. For the softening point, the temperature at which efflux of half of the sample occurred was taken as such. Measurement of the glass transition point was made with respect to 10 mg of sample weighed using a differential scanning calorimeter (DSC-200; made by Seiko Denshi K. K.) and, with alumina used as a reference, a shoulder value of main endothermic peak within a temperature range of 30 to 80° C. was taken as the glass transition point.

Example 1

First, 150 g of hydrophobic silica (TS500; made by Cabosil K.K. BET specific surface area, 225 $m^2/g$), as metal oxide particulate, were introduced into a 9-liter capacity Henschel mixer (made by Mitsui Kozan K. K.), and disintegrated at a peripheral speed of 40 m/sec. for 90 sec. Then, 1 kg of the binder resin, 30 g of chromatic coloring material, C. I. pigment red 184, (secondary agglomerate volume mean particle size, about 2.5 μm), and 30 g of the disintegrated hydrophobic silica were introduced into the Henschel mixer and subjected to a first stage mixing at a peripheral speed of 40 m/sec. for 4 minutes. Into the resulting mixture were introduced a negative charge control agent (E-84; made by Orient Kagaku Kogyo K. K.), 5 g, and a carnauba wax (made by Kato Yoko K. K.), 20 g, and second stage mixing was carried out for 5 minutes at a peripheral speed of 40 m/sec. Into the mixture thus obtained were introduced 150 g of collected dust-size toner particles (classified fine toner particles of the same composition as the mixture), and third stage mixing was carried out at a peripheral speed of 40 m/sec. for 5 minutes.

The resulting mixture was kneaded in a twin-screw extruder-kneader (PCM-30; made by Ikegai Tekko K. K.) and, after having been cooled, the kneaded mixture was primarily crushed in a feather mill, and then the resulting coarse particles were pulverized in a jet mill. Fine particles thus obtained were minutely classified by means of an air classifier. As a result, magenta toner particles having a volume-mean particle size of 8.5 μm were obtained. It is noted that volume-mean particle size measurement was made using a Coulter counter (made by Coulter Electronics K.K.).

Hydrophobic silica (TS500; made by Cabosil K.K.), 0.8 part by weight, was added to 100 parts by weight of toner particles thus obtained, and mixing was carried out for 2 minutes by using a Henschel mixer at a peripheral speed of 20 m/sec. Thus, magenta toner 1 was obtained.

A yellow toner 1 having a volume-mean particle size of 8.4 μm was obtained in the same way as in the case of the magenta toner 1, except that C. I. pigment yellow 180 (secondary agglomerate volume-mean particle size, about 3 μm) was used as chromatic coloring material. Similarly, a cyan toner 1 having a volume-mean particle size of 8.7 μm was obtained in the same way as in the case of the magenta toner 1, except that C. I. pigment blue 15-3 (secondary agglomerate volume-mean particle size, about 2.5 μm) was used as chromatic coloring material.

Example 2

Magenta toner 2, yellow toner 2, and cyan toner 2 were obtained in the same way as in Example 1, except that the addition of the hydrophobic silica was made in the amount of 10 g.

Example 3

Magenta toner 3, yellow toner 3, and cyan toner 3 were obtained in the same way as in Example 1, except that the addition of hydrophobic silica was made in the amount of 3 g.

Example 4

Magenta toner 4, yellow toner 4, and cyan toner 4 were obtained in the same way as in Example 1, except that for the hydrophobic silica, R972 (made by Aerosil Japan; BET specific surface area, 110 $m^2/g$) was used in the amount of 40 g.

Example 5

Magenta toner 5, yellow toner 5, and cyan toner 5 were obtained in the same way as in Example 1, except that hydrophobic titanium dioxide (T805; made by Aerosil Japan; BET specific surface area, 35 $m^2/g$), 30 g, was used instead of hydrophobic silica.

Example 6

Magenta toner 6, yellow toner 6, and cyan toner 6 were obtained in the same way as in Example 5, except that the addition of hydrophobic titanium dioxide was made in the amount of 120 g.

Example 7

Magenta toner 7, yellow toner 7, and cyan toner 7 were obtained in the same way as in Example 1, except that prior to the first mixing step, 30 g of chromatic coloring material and 30 g of hydrophobic silica were premixed and disintegrated by using a surface modifier (hybridization; made by Nara Kikai Seisakusho K. K.), the first mixing step being carried out thereafter using the pre-mixed components and 1 kg of binder resin.

Comparative Example 1

Magenta toner 8, yellow toner 8, and cyan toner 8 were obtained in the same way as in Example 1, except that all materials were mixed together for 15 minutes in one stage without being separated into parts.

Comparative Example 2

Magenta toner 9, yellow toner 9, and cyan toner 9 were obtained in the same way as in Example 1, except that a binder resin and a chromatic coloring material only were mixed at the first mixing step, and that hydrophobic silica, carnauba wax, and a charge control agent were introduced into the first-stage mixture for mixing therewith at the second mixing step.

Comparative Example 3

Magenta toner 10, yellow toner 10, and cyan toner 10 were obtained in the same way as in Example 1, except that the amount of addition of hydrophobic silica at the first mixing step was changed to 1 g.

Comparative Example 4

Magenta toner 11, yellow toner 11, and cyan toner 11 were obtained in the same way as in Example 1, except that no hydrophobic silica was added at the first mixing step.

Comparative Example 5

Magenta toner 12, yellow toner 12, and cyan toner 12 were obtained in the same way as in Example 5, except that the quantity of addition of hydrophobic titanium dioxide was changed to 300 g.

Comparative Example 6

Magenta toner 13, yellow toner 13, and cyan toner 13 were obtained in the same way as in Comparative Example 1, except that no hydrophobic titanium dioxide was added.

With respect to color toners (magenta toners, yellow toners, and cyan toners) 1–13 obtained in manner as described above, a full-color image was formed on an OHP sheet using a full-color printer of the non-magnetic one-component developing system which will be explained hereinafter. Each imagethus formed was projected by OHP onto a screen, and the color image on the screen was visually evaluated. In color development evaluation, where good color reproduction was observed, the toner was rated ◎; where color reproduction was somewhat less favorable, the toner was rated ○; where color reproduction was inferior, but color discrimination was possible, the toner was rated Δ; and where color discrimination was difficult, the toner was rated x. In transparency evaluation, where the image was found clear, the toner was rated ◎; where the image was found slightly less clear, the toner was rated ○; where the image was found somewhat dark, the toner was rated Δ; and where the image was found dark, the toner was rated x. The results are shown in Table 1.

TABLE 1

| | Color toner | Multi-stage mixing | Time for fine particle addition | Colorant:Fine particle | Color develop property | Trans-par-ancy |
|---|---|---|---|---|---|---|
| Ex. 1 | 1 | Yes | First mixing | 1:1 | ○~◎ | ○~◎ |
| Ex. 2 | 2 | Yes | First mixing | 3:1 | ○~◎ | ○ |
| Ex. 3 | 3 | Yes | First mixing | 10:1 | ○ | ○ |
| Ex. 4 | 4 | Yes | First mixing | 3:4 | ◎ | ○~◎ |
| Ex. 5 | 5 | Yes | First mixing | 1:1 | ○~◎ | ○ |
| Ex. 6 | 6 | Yes | First mixing | 1:4 | ○ | ◎ |
| Ex. 7 | 7 | Yes | First mixing | 1:1 | ◎ | ◎ |
| Comp. Ex. 1 | 8 | No | Collective mixing | 1:1 | Δ | ○ |
| Comp. Ex. 2 | 9 | Yes | Second mixing | 1:1 | Δ | ○ |
| Comp. Ex. 3 | 10 | Yes | First mixing | 30:1 | Δ | x |
| Comp. Ex. 4 | 11 | Yes | — | — | Δ | x |
| Comp. | 12 | Yes | First | 1:10 | ○ | Δ |

TABLE 1-continued

| | Color toner | Multi-stage mixing | Time for fine particle addition | Colorant:Fine particle | Color develop property | Trans-par-ancy |
|---|---|---|---|---|---|---|
| Ex. 5 | | | mixing | | | |
| Comp. Ex. 6 | 13 | No | — | — | x | x |

The full-color printer employed for the purpose of this evaluation is of such a construction as shown in FIG. 1, and includes a photosensitive drum 10 (hereinafter referred to as "sensitive member 10") driven to rotate in the direction of arrow in the drawing, a laser scan optical system 20, a full-color developing assembly 30, an endless intermediate transfer belt 40 driven to rotate in the direction of arrow in the drawing, and a sheet feeder portion 60. Around the sensitive member 10 there are provided a charging brush 11 for charging the surface of the sensitive member 10 to a predetermined potential, and a cleaner 12 for removing any toner residue present on the sensitive member 10.

The laser scan optical system 20 is a well-known system incorporating a laser diode, a polygon mirror, and an fθ optical element, and has a controller to which print data for cyan (C), magenta (M), yellow (Y), and black (BK) are transmitted from the host computer. The laser scan optical system 20 sequentially output print data for each respective color in the form of laser beam and scan over the sensitive member 10 for exposure, whereby electrostatic latent images for respective colors are sequentially formed on the sensitive member 10.

The full-color developing assembly 30 is an integral assembly of four separate color developing units 31C, 31M, 31Y, 31BK in which are housed respective one-component developing agents composed respectively of non-magnetic C, M, Y and BK toners, and is rotatable clockwise about a support shaft 33. Each color developing unit includes a developing sleeve 32, toner regulator blades 34*a* and 34*b*. Toner particles transported through the rotation of the developing sleeve 32 are charged by their passing through a pressure contact portion (regulator portion) between the blades 34*a*, 34*b* and the developing sleeve 32.

The intermediate transfer belt 40 is driven to rotate synchronously with the sensitive member 10 in the direction of the arrow shown in the drawing. The intermediate transfer belt 40 is pressed by a freely rotatable first transfer roller 41 into contact with the sensitive member 10. The intermediate transfer belt 40 is in contact with a freely rotatable second transfer roller 43 at a portion supported by a support roller 42.

A cleaner 50 is disposed in a space between the developing assembly 30 and the intermediate transfer belt 40. The cleaner 50 has a blade for removing any toner residue on the intermediate transfer belt 40. The blade and the second transfer roller 43 are movable toward and away from the intermediate transfer belt 40.

The sheet feeder portion 60 includes a feed tray 61 adapted to open on the front side of the image forming apparatus 1, a feed roller 62 and a timing roller 63. Recording sheets S, loaded on the feeder tray 61, are fed one by one rightward by the feed roller 62 and delivered by the timing roller 63 toward the second transfer section in synchronous relation with an image formed on the intermediate transfer belt 40. A horizontal transport path for recording sheets comprises an air suction belt 66 and the like, including the sheet feeder portion, and a vertical transport path 80 equipped with transport rollers extends from a fixing unit 70. Each recording sheet S is discharged from the vertical transport path 80 onto the top surface of the image forming apparatus body 1.

In this conjunction, printing operation of the full-color printer will be explained. When printing operation begins, the sensitive member 10 and the intermediate transfer belt 40 are driven to rotate at an equal peripheral speed, and the sensitive member 10 is charged by the charging brush 11 to a predetermined potential.

Subsequently, a cyan image is exposed by the laser scan optical system 20 so that an electrostatic latent image of the cyan image is formed on the sensitive member 10. The electrostatic latent image is immediately developed at developing unit 31C and a toner image is transferred onto the intermediate transfer belt 40 at the first transfer section. Immediately upon the completion of the first transfer, developing unit 31M is switched over to the developing section D, followed by exposure, development and first transfer with respect to magenta image. Then, switching over to developing unit Y is carried out, followed by exposure, development, and first transfer with respect to yellow image. Again, switching over to developing unit 31BK is carried out, followed by exposure, development, and first transfer with respect to black image. Each time when a first transfer is made, a toner image is placed on the intermediate transfer belt 40 in superposed relation to a previously placed toner image.

Upon completion of a final first transfer, recording sheet S is delivered to a second transfer section and a full-color toner image formed on the intermediate transfer belt 40 is transferred onto the recording sheet S. Upon completion of the second transfer, recording sheet S is transported to a belt-type heat fixing device 70, and a full-color toner image is fixed on the recording sheet S, which is in turn discharged onto the upper surface of the printer body 1.

Preparation of Binder Resin Particles A1 and A2

The polyester resin A was pulverized in a feather mill (screen: 3 mm), and resulting particles were sifted through a 28-mesh screen. Particles present on the screen were classified as binder resin particles A1 (mean particle size: 1.8 mm), and particles which passed through the screen was classified as binder resin particles A2 (mean particle size: 0.3 mm)

Preparation of Binder Resin Particles A3

The polyester resin was pulverized in a feather mill (screen: 5 mm), and resulting particles were sifted through an 8-mesh screen. Particles present on the screen were classified as binder resin particles A3 (mean particle size: 3.7 mm).

Preparation of Binder Resin Particles A4

The binder resin particles A2 were further sifted through a 120-mesh screen, and particles which have passed through the screen were classified as binder resin particles A4 (mean particle size: 0.06 mm).

Example 8

Three hundred grams (300 g) of binder resin particles A1, and 30 g of chromatic coloring material, C. I. pigment red 184, (secondary agglomerate volume mean particle size, about 3 μm) were introduced into a 9-liter capacity Henschel mixer and subjected to first-stage mixing wherein mixing was carried out at a peripheral speed of 40 m/sec. for 5 minutes. Into the resulting mixture were introduced binder resin particles A2, 700 g, and a negative charge control agent (E-84; made by Orient Kagaku Kogyo K. K.), 10 g, and second stage mixing was carried out at a peripheral speed of 40 m/sec. for 4 minutes.

The resulting mixture was kneaded in a twin-screw extruder-kneader (PCM-30; made by Ikegai Tekko K. K.) and, after having been cooled, the kneaded mixture was primarily crushed in a feather mill, and then the resulting coarse particles were pulverized in a jet mill. Fine particles thus obtained were minutely classified by means of an air classifier. As a result, magenta toner particles having a volume-mean particle size of 8.6 μm were obtained. It is to be noted that the volume-mean particle size values herein are based on measurements by a Coulter counter (made by Coulter Electronics).

Into a Henschel mixer were introduced 1000 g of toner particles thus obtained, and 8 g of hydrophobic silica (TS500; made by Cabosil K.K.) previously disintegrated in a Henschel mixer, and mixing was carried out at a peripheral speed of 20 m/sec. for 2 minutes. Thus, magenta toner 14 was obtained.

A yellow toner 14 having a volume-mean particle size of 8.8 μm was obtained in the same way as in the case of the magenta toner 14, except that C. I. pigment yellow 180 (secondary agglomerate volume-mean particle size, about 2.5 μm) was used as chromatic coloring material. Similarly, a cyan toner 14 having a volume-mean particle size of 8.3 μm was obtained in the same way as in the case of the magenta toner 14, except that C. I. pigment blue 15-3 (secondary agglomerate volume-mean particle size, about 3 μm) was used as chromatic coloring material.

Example 9

Magenta toner 15, yellow toner 15, and cyan toner 15 were obtained in the same way as in Example 8, except that the quantity of binder resin particles A1 was changed to 600 g and that the quantity of binder resin particles A2 was changed to 400 g.

Example 10

Magenta toner 16, yellow toner 16, and cyan toner 16 were obtained in the same way as in Example 8, except that the material to be introduced at the second mixing step was binder resin particles A2 only, and that a negative charge control agent was added to the mixture obtained at the second mixing step, the resulting mixture being subjected to a third step mixing at a peripheral speed of 40 m/sec. for 3 minutes.

Example 11

Magenta toner 17, yellow toner 17, and cyan toner 17 were obtained in the same way as in Example 8, except that the materials to be added at the second mixing step were changed to 700 g of binder resin particles A2, 10 g of charge control agent, 20 g of carnauba wax (made by Kato Yoko K. K.), and 10 g of hydrophobic silica (H2000; made by Hoechst; BET specific surface area, 140 $m^2/g$).

Example 12

Magenta toner 18, yellow toner 18, and cyan toner 18 were obtained in the same way as in Example 11, except that the material introduced at the second mixing step was binder resin particles A2 only and that a negative charge control agent, carnauba wax, and hydrophobic silica were introduced for third step mixing wherein mixing was carried out at a peripheral speed of 40 m/sec for 3 minutes.

Comparative Example 7

Magenta toner 19, yellow toner 19, and cyan toner 19 were obtained in the same way as in Example 8, except that 1 kg of binder resin particles A1 and 30 g of chromatic coloring material were mixed at a peripheral speed of 40 m/sec for 9 minutes and that 10 g of negative charge control agent were introduced into the mixture obtained at the first mixing step for third step mixing in which mixing was carried out at a peripheral speed of 40 m/sec for 3 minutes.

Comparative Example 8

Magenta toner 20, yellow toner 20, and cyan toner 20 were obtained in the same way as in Comparative Example 7, except that binder resin particle A1 was changed to binder resin particle A2.

Comparative Example 9

Magenta toner 21, yellow toner 21, and cyan toner 21 were obtained in the same way as in Comparative Example 7, except that binder resin particle A1 (1 kg) was changed to binder resin particle A1 (600 g) and binder resin particle A2 (400 g).

Comparative Example 10

Magenta toner 22, yellow toner 22, and cyan toner 22 were obtained in the same way as in Example 8, except that binder resin particle A1 was changed to binder resin particle A3.

Comparative Example 11

Magenta toner 23, yellow toner 23, and cyan toner 23 were obtained in the same way as in Example 8, except that binder resin particle A2 was changed to binder resin particle A4.

Comparative Example 12

Magenta toner 24, yellow toner 24, and cyan toner 24 were obtained in the same way as in Comparative Example 7, except that 10 g of negative charge control agent, 20 g of carnauba wax (made by Kato Yoko K. K.), and 10 g of hydrophobic silica (H2000; made by Hoechst) were introduced at the second mixing stage.

With respect to color toners 14 to 24 obtained in manner as described above, color developing properties and transparency were evaluated in the same way as in Example 1. The results are shown in Table 2.

| | Color toner | Time for large-size particle addition | Time for small-size Particle addition | Color develop property | Trans-parancy |
|---|---|---|---|---|---|
| Ex. 8 | 14 | First mixing | Second mixing | ○ | ○ |
| Ex. 9 | 15 | First mixing | Second mixing | ○ | ○ |
| Ex. 10 | 16 | First mixing | Second mixing | ○ | ○ |
| Ex. 11 | 17 | First mixing | Second mixing | ○ | ◎ |
| Ex. 12 | 18 | First mixing | Second mixing | ◎ | ◎ |
| Comp. | 19 | First | — | Δ | Δ |

-continued

| | Color toner | Time for large-size particle addition | Time for small-size Particle addition | Color develop property | Trans-parancy |
|---|---|---|---|---|---|
| Ex. 7 | | mixing | | | |
| Comp. Ex. 8 | 20 | — | First mixing | x~Δ | x |
| Comp. Ex. 9 | 21 | First mixing | First mixing | Δ~○ | x~Δ |
| Comp. Ex. 10 | 22 | First mixing | Second mixing | x~Δ | x |
| Comp. Ex. 11 | 23 | First mixing | Second mixing | Δ | Δ |
| Comp. Ex. 12 | 24 | First mixing | — | Δ | ○ |

In the following examples and comparative examples, polyester resin A pulverized to a volume-mean particle size of about 0.8 mm was used as binder resin.

Master Batch Preparation Example 1

Five hundred and forty (540) g of above mentioned polyester resin, 230 g of chromatic coloring material, C. I. pigment red 184 (secondary agglomerate volume mean particle size, about 3 μm), and 230 g of hydrophobic silica (R972; made by Aerosil Japan; BET specific surface area, 110 $m^2/g$) were introduced into a 9-liter capacity Henschel mixer (made by Mitsui Kozan K. K.) and were mixed at a peripheral speed of 40 m/sec. for 4 minutes. The resulting mixture was melted and kneaded in a twin-screw kneader-extruder (PCM-30; made by Ikegai Tekko K. K.) and, after having been cooled, the kneaded mixture was pulverized in a feather mill and thus a magenta master batch A was obtained.

A yellow master batch A was obtained in the same way as in the case of the magenta master batch A, except that C. I. pigment yellow 180 (secondary agglomerate volume-mean particle size, about 2.5 μm) was used as chromatic coloring material. Similarly, a cyan master batch A was obtained in the same way as in the case of the magenta master batch A, except that C. I. pigment blue 15-3 (secondary agglomerate volume-mean particle size, about 3 μm) was used as chromatic coloring material.

Master Batch Preparation Example 2

Magenta master batch B, yellow master batch B, and cyan master batch B were obtained in the same way as in Master Batch Preparation Example 1, except that the period of material mixing was changed to 10 minutes.

Master Batch Preparation Example 3

Magenta master batch C, yellow master batch C, and cyan master batch C were obtained in the same way as in Master Batch Preparation Example 1, except that the loading of hydrophobic silica was changed to 10 g.

Master Batch Preparation Example 4

Magenta master batch D, yellow master batch D, and cyan master batch D were obtained in the same way as in Master Batch Preparation Example 1, except that the hydrophobic silica (R972) was changed to hydrophobic silica (H2000; made by Hoechst; BET specific surface area, 140 $m^2/g$), 230 g.

Master Batch Preparation Example 5

Magenta master batch E, yellow master batch E, and cyan master batch E were obtained in the same way as in Master Batch Preparation Example 1, except that the hydrophobic silica (972) was changed to hydrophobic titanium dioxide (T805; made by Aerosil Japan; BET specific surface area, 35 $m^2/g$), 230 g.

Master Batch Preparation Example 6

Magenta master batch F, yellow master batch F, and cyan master batch F were obtained in the same way as in Master Batch Preparation Example 1, except that for the polyester resin and chromatic coloring material, those which had been previously ground and disintegrated in a jet mill were used.

Master Batch Preparation Example 7

Magenta master batch G, yellow master batch G, and cyan master batch G were obtained in the same way as in Master Batch Preparation Example 1, except that a mixture of hydrophobic silica and chromatic coloring material which had been previously mixed and disintegrated in a surface modifier (Hybridization: made by Nara Kikai Seisakusho K. K.) was used as such.

Master Batch Preparation Example 8

Magenta master batch H, yellow master batch H, and cyan master batch H were obtained in the same way as in Master Batch Preparation Example 1, except that the hydrophobic silica (R972) was not added.

Master Batch Preparation Example 9

Magenta master batch I, yellow master batch I, and cyan master batch I were obtained in the same way as in Master Batch Preparation Example 2, except that the hydrophobic silica (R972) was not added.

Master Batch Preparation Example 10

Magenta master batch J, yellow master batch J, and cyan master batch J were obtained in the same way as in Master Batch Preparation Example 6, except that the hydrophobic silica (R972) was not added.

Example 13

Magenta master batch A, 150 g, aforesaid polyester resin, 900 g, a negative charge control agent (E-84; made by Orient Kagaku Kogyo K. K.), 10 g, and carnauba wax (made by Kato Yoko K. K.), 20 g were introduced into a 9-liter Henschel mixer (made by Mitsui Kozan K. K.), and mixing was carried out at a peripheral speed of 40 m/sec. for 5 minutes.

The resulting mixture was kneaded in a twin-screw extruder-kneader (PCM-30; made by Ikegai Tekko K. K.), and after having been cooled, the kneaded mixture was primarily crushed in a feather mill, and pulverized in a jet mill. Fine particles thus obtained were then minutely classified by an air classifier. As a result, magenta toner particles having a volume-mean particle size of 8.5 μm were obtained. It is to be noted that the volume-mean particle size value is based on measurements by a Coulter counter (made by Coulter Electronics).

Toner particles thus obtained, 1 kg, and hydrophobic silica (H2000; made by Hoechst K.K.), 10 g were introduced into a Henschel mixer, and mixing was carried out at a peripheral speed of 20 m/sec for 2 minutes. Thus, magenta toner 25 was obtained.

Yellow toner 25 was obtained in the same way as in the case of magenta toner 25, except that yellow master batch A was used instead of magenta master batch A. Similarly, cyan toner 25 was obtained in the same way as in the case of magenta toner 25, except that cyan master batch A was used instead of magenta master batch A.

Example 14

Magenta toner 26, yellow toner 26, and cyan toner 26 were obtained in the same way as in Example 13, except that (magenta, yellow, cyan) master batch B was used instead of (magenta, yellow, cyan) master batch A.

Example 15

Magenta toner 27, yellow toner 27, and cyan toner 27 were obtained in the same way as in Example 13, except that (magenta, yellow, cyan) master batch C was used instead of (magenta, yellow, cyan) master batch A.

Example 16

Magenta toner 28, yellow toner 28, and cyan toner 28 were obtained in the same way as in Example 13, except that (magenta, yellow, cyan) master batch D was used instead of (magenta, yellow, cyan) master batch A.

Example 17

Magenta toner 29, yellow toner 29, and cyan toner 29 were obtained in the same way as in Example 13, except that (magenta, yellow, cyan) master batch E was used instead of (magenta, yellow, cyan) master batch A.

Example 18

Magenta toner 30, yellow toner 30, and cyan toner 30 were obtained in the same way as in Example 13, except that (magenta, yellow, cyan) master batch F was used instead of (magenta, yellow, cyan) master batch A.

Example 19

Magenta toner 31, yellow toner 31, and cyan toner 31 were obtained in the same way as in Example 13, except that (magenta, yellow, cyan) master batch G was used instead of (magenta, yellow, cyan) master batch A.

Comparative Example 13

Magenta toner 32, yellow toner 32, and cyan toner 32 were obtained in the same way as in Example 13, except that (magenta, yellow, cyan) master batch H was used instead of (magenta, yellow, cyan) master batch A.

Comparative Example 14

Magenta toner 33, yellow toner 33, and cyan toner 33 were obtained in the same way as in Example 13, except that (magenta, yellow, cyan) master batch I was used instead of (magenta, yellow, cyan) master batch A.

Comparative Example 15

Magenta toner 34, yellow toner 34, and cyan toner 34 were obtained in the same way as in Example 13, except that (magenta, yellow, cyan) master batch J was used instead of (magenta, yellow, cyan) master batch A.

Comparative Example 16

Magenta toner 35, yellow toner 35, and cyan toner 35 were obtained in the same way as in Example 13, except that 1 kg of polyester resin, 30 g of chromatic coloring material, 10 g of charge control agent, and 20 g of carnauba wax were used as materials for being mixed together at the material mixing step, and that the period of time of mixing was changed to 10 minutes.

Color toners 25–35 obtained in manner as described above were evaluated in respect of color developing performance and transparency in the same way as in the case of Example 1. The results are shown in Table 3.

TABLE 3

| | Color toner | Master batch | Metal oxide | Color develop property | Transparency |
|---|---|---|---|---|---|
| Ex. 13 | 25 | A | Added | ○ | ◎ |
| Ex. 14 | 26 | B | Added | ○~◎ | ◎ |
| Ex. 15 | 27 | C | Added | ○ | Δ~○ |
| Ex. 16 | 28 | D | Added | ○ | ◎ |
| Ex. 17 | 29 | E | Added | ○ | ○ |
| Ex. 18 | 30 | F | Added | ○~◎ | ◎ |
| Ex. 19 | 31 | G | Added | ◎ | ◎ |
| Comp. Ex. 13 | 32 | H | Not added | x~○ | x |
| Comp. Ex. 14 | 33 | I | Not added | Δ | x~Δ |
| Comp. Ex. 15 | 34 | J | Not added | Δ | Δ |
| Comp. Ex. 16 | 35 | — | Not added | x | x |

In the following examples and comparative examples, polyester resin A pulverized to a volume-mean particle size of about 0.8 mm was used as binder resin.

Example 20

First, 150 g of hydrophobic silica (H-2000; made by Hoechst Industry; BET specific surface area, 140 $m^2/g$), as metal oxide particulate, were introduced into a 9-liter capacity Henschel mixer (made by Mitsui Kozan K. K.), and disintegrated at a peripheral speed of 40 m/sec. for 90 sec. Then, 1 kg of the binder resin, 30 g of chromatic coloring material, C. I. pigment red 81 (secondary agglomerate volume mean particle size, about 2.5 $\mu$n), and 30 g of the disintegrated hydrophobic silica were introduced into the Henschel mixer and subjected to first stage mixing at a peripheral speed of 40 m/sec. for 30 minutes. Into the resulting mixture were introduced a negative charge control agent (E-84; made by Orient Kagaku Kogyo K. K.), 5 g, and a carnauba wax (made by Kato Yoko K. K.), 20 g, and second stage mixing was carried out for 5 minutes at a peripheral speed of 40 m/sec. Into the mixture thus obtained were introduced 250 g of collected dust-size toner particles, and third-stage mixing was carried out at a peripheral speed of 40 m/sec. for 10 minutes.

The resulting mixture was kneaded in a twin-screw extruder-kneader (PCM-30; made by Ikegai Tekko K. K.) and, after having been cooled, the kneaded mixture was primarily crushed in a feather mill, and then the resulting coarse particles were pulverized in a jet mill. Fine particles thus obtained were minutely classified by means of an air classifier. As a result, magenta toner 36 having a volume-mean particle size of 8.0 $\mu$m was obtained.

Yellow toner 36 was obtained in the same way as the magenta toner 36, except that C. I. pigment yellow 180 (secondary agglomerate volume-mean particle size, about 3 $\mu$m) was used as chromatic coloring material. Similarly, cyan toner 36 was obtained in the same way as the magenta toner 36, except that C. I. pigment blue 15-3 (secondary agglomerate volume-mean particle size, about 2.5 μm) was used as chromatic coloring material.

Example 21

Magenta toner 37, yellow toner 37, and cyan toner 37 were obtained in the same way as in Example 20, except that the quantity of addition of the hydrophobic silica was 10 g.

Example 22

Magenta toner 38, yellow toner 38, and cyan toner 38 were obtained in the same way as in Example 20, except that hydrophobic titanium dioxide (T805; made by Aerosil Japan; BET specific surface area, 35 $m^2/g$), 30 g, was used instead of hydrophobic silica.

Example 23

Magenta toner 39, yellow toner 39, and cyan toner 39 were obtained in the same way as in Example 20, except that the hydrophobic silica used was R972 (made by Aerosil Japan; BET specific surface area, 110 $m^2/g$), 30 g.

Example 24

Magenta toner 40, yellow toner 40, and cyan toner 40 were obtained in the same way as in Example 20, except that mixing at the first mixing step was carried out for 20 minutes.

Comparative Example 17

Magenta toner 41, yellow toner 41, and cyan toner 41 were obtained in the same way as in Example 20, except that mixing was carried out in one stage and not in two separate stages (first mixing, second mixing) and that the period of mixing was 40 minutes.

Comparative Example 18

Magenta toner 42, yellow toner 42, and cyan toner 42 were obtained in the same way as in Example 20, except that there was no loading of hydrophobic silica.

Comparative Example 19

Magenta toner 43, yellow toner 43, and cyan toner 43 were obtained in the same way as in Example 20, except that the first mixing step was carried out in the following way. That is, 100 g of a master batch composed of binder resin and chromatic coloring material pre-kneaded in a high concentration ratio of 7:3; 930 g of binder resin, and 30 g of chromatic coloring material were introduced into a Henschel mixer, and mixing was carried out at a peripheral speed of 40 m/sec for 4 minutes.

Individual toners obtained as described above were evaluated in respect of surface smoothness and absorbance values expressed by relations (1), (2) and (3). Measurements were made in the following way.

First, 4 cc of toluene and 1 g of sample toner were put in a 10 cc screw tube, and rotary mixing was carried out by a vial rotator at 300 rpm to cause the toner to be dissolved. Then, the resulting solution was allowed to drop on a transparent sheet (OHP sheet) and the solution was uniformly coated on the sheet by using a wire-wrapped bar coater while diametrically adjusting the wire wrap so as to provide a dried coat thickness of 10 to 20 μm, and then the coating was dried. Measurement of the dried coat thickness was made by using an eddy current film thickness measuring device (made by Fisher K.K.). The glossiness of the toner film thus obtained was measured by using a gloss meter (GM-060; made by Minolta K. K.). The glossiness was calculated from the relation: (reflected luminous flux from sample/reflected luminous flux from standard glass)×100. Measurement was made under the following conditions: angle of incidence and reflection of measured light was fixed at 60°; and glossiness of the standard glass having a refractive index of 1.567 was taken as 100.

Next, with respect to magenta toner (500–600 nm), yellow toner (380–500 nm), and cyan toner (600–800 nm), maximum absorbance in each respective wave range, and minimum absorbance of each toner in a wave range of 400 to 800 nm were measured by using a self-spectrophotometer (U-3200; made by Hitachi Seisakusho K. K.) and, for each respective toner film, spectroral absorbance was determined on the basis of these measurements and in accordance with the relations (1), (2) and (3). The results are shown in Tables 4 to 6.

Documents with stepwise density variations were prepared for each of magenta, yellow, and cyan, and an image of each document was formed on an OHP sheet by using a full-color copying machine CF900 (made by Minolta K. K.). The image was projected onto a screen, and an image portion on the screen which corresponds to a toner film portion having a film thickness of 10 μm±0.5 μm was visually evaluated. Toner film thickness was measured by an eddy current film thickness measuring device (made by Fisher K.K.). In color development evaluation, where good color reproduction was observed, the toner was rated ◎; where color reproduction was slightly less favorable, the toner was rated ○; where color was somewhat dull, the toner was rated Δ; and where color was dull, the toner was rated x. Intransparency evaluation, where the image was found clear, the toner was rated ◎; where the image was found slightly less clear, the toner was rated ○; where the image was found somewhat dark, the toner was rated Δ; and where the image was found dark, the toner was rated x. The results are shown in Tables 4 to 6.

TABLE 4

| | Magenta Toner | Gloss | $(A_{MP} - A_{MB})/A_{MB}$ | Color develop Property | Trans-parency |
|---|---|---|---|---|---|
| Ex. 20 | 36 | 115 | 115 | ◎ | ◎ |
| Ex. 21 | 37 | 108 | 93 | ◎ | ○ |
| Ex. 22 | 38 | 112 | 91 | ◎ | ○ |
| Ex. 23 | 39 | 113 | 96 | ◎ | ○ |
| Ex. 24 | 40 | 108 | 88 | ○ | ○ |
| Comp. Ex. 17 | 41 | 105 | 79 | ○ | Δ |
| Comp. Ex. 18 | 42 | 102 | 73 | Δ | Δ |
| Comp. Ex. 19 | 43 | 95 | 54 | x | x |

TABLE 5

| | Yellow Toner | Gloss | $(A_{VP} - A_{VB})/A_{VB}$ | Color develop property | Trans-parency |
|---|---|---|---|---|---|
| Ex. 25 | 36 | 125 | 101 | ◎ | ◎ |
| Ex. 26 | 37 | 115 | 82 | ◎ | ◎ |
| Ex. 27 | 38 | 113 | 80 | ◎ | ◎ |

TABLE 5-continued

| | Yellow Toner | Gloss | $(A_{VP} - A_{VB})/A_{VB}$ | Color develop property | Trans-parency |
|---|---|---|---|---|---|
| Ex. 28 | 39 | 119 | 85 | ◎ | ◎ |
| Ex. 29 | 40 | 110 | 78 | ◎ | ○ |
| Comp. Ex. 20 | 41 | 102 | 70 | ○ | Δ |
| Comp. Ex. 21 | 42 | 99 | 64 | Δ | Δ |
| Comp. Ex. 22 | 43 | 98 | 54 | Δ | Δ |

TABLE 6

| | Cyan toner | Gloss | $(A_{CP} - A_{CB})/A_{CB}$ | Color develop property | Trans-parency |
|---|---|---|---|---|---|
| Ex. 30 | 36 | 110 | 61 | ◎ | ◎ |
| Ex. 31 | 37 | 105 | 49 | ◎ | ○ |
| Ex. 32 | 38 | 107 | 48 | ◎ | ○ |
| Ex. 33 | 39 | 107 | 51 | ◎ | ◎ |
| Ex. 34 | 40 | 105 | 47 | ◎ | ○ |
| Comp. Ex. 23 | 41 | 100 | 42 | ○ | ○ |
| Comp. Ex. 24 | 42 | 98 | 39 | Δ | Δ |
| Comp. Ex. 25 | 43 | 96 | 29 | Δ | x |

What is claimed is:

1. A method of producing a color toner which comprises the following steps:

a first mixing step for mixing a binder resin, a chromatic coloring material, and metal oxide particulate, wherein the weight ratio of the chromatic coloring material to the metal oxide particulate is 10:1–1:5;

a second mixing step for mixing the mixture obtained at the first mixing step and a material other than the materials used in the first mixing step;

the step of melting and kneading the mixture obtained at the second mixing step;

the step of pulverizing the kneaded mixture after the mixture has been cooled; and the step of classifying the resulting pulverized material.

2. A method of producing a color toner as set forth in claim 1, wherein the other material used for mixing in the second mixing step is at least one of a charge control agent and a wax.

3. A method of producing a color toner as set forth in claim 1, further comprising a third mixing step for mixing toner particles collected at the classifying step into the mixture obtained at the second mixing step.

4. A method of producing a color toner as set forth in claim 1, further comprising the step of premixing the chromatic coloring material and the metal oxide particulate prior to the first mixing step.

5. A method of producing a color toner as set forth in claim 1, wherein the metal oxide particulate has a BET specific surface area of 20 to 300 $m^2/g$.

6. A method of producing a color toner as set forth in claim 5, wherein the metal oxide particulate is surface-treated with a hydrophobicizing agent.

7. A method of producing a color toner as set forth in claim 1, wherein a melting viscosity $V_2$ of the binder resin at 100° C. is $5\times10^4$ to $1\times10^6$ poise, and a ratio $V_1/V_2$ of melting viscosity $V_1$ of the binder resin at 90° C. to the melting viscosity $V_2$ is 8 or more.

8. A method of producing a color toner which comprises the following steps:

a first mixing step for mixing a binder resin having a mean particle size of 1 to 3 mm, and a chromatic coloring material;

a second mixing step for mixing the mixture obtained at the first mixing step and a binder resin having a mean particle size of 0.1 to 0.5 mm;

a step of melting and kneading the mixture obtained at the second mixing step;

a step of pulverizing the kneaded mixture after the mixture is cooled; and a step of classifying the resulting pulverized material.

9. A method of producing a color toner as set forth in claim 8, further comprising a third mixing step for mixing materials other than those used in the first and second material mixing steps.

10. A method of producing a color toner as set forth in claim 8, wherein at the second mixing step a material other than those used at the first mixing step is mixed along with the binder resin having a mean particle size of 0.1 to 0.5 mm.

11. A master batch for use in a color toner comprising:

a binder resin, 20 to 100 parts by weight of a chromatic coloring material relative to 100 parts by weight of the binder resin, and metal oxide particulate.

12. A master batch as set forth in claim 11, wherein the weight ratio of the chromatic coloring material to the metal oxide particulate (coloring material:metal oxide) is 10:1 to 1:5.

13. A master batch as set forth in claim 11, wherein the metal oxide particulate has a BET specific surface area of 20 to 300 $m^2/g$.

14. A master batch as set forth in claim 13, wherein the metal oxide particulate is surface-treated with a hydrophobicizing agent.

15. A method of producing a color toner which comprises the following steps:

a master batch preparing step for preparing a master batch containing a binder resin, 20 to 100 parts by weight of a chromatic coloring agent relative to 100 parts by weight of the binder resin, and metal oxide particulate;

a first mixing step for mixing the master batch and a binder resin;

a second mixing step for mixing the mixture obtained at the first mixing step and a material other than the materials used in the first mixing step;

a step of melting and kneading the mixture obtained;

a step of pulverizing the kneaded mixture after the mixture is cooled; and a step of classifying the resulting pulverized material.

16. A method of producing a color toner as set forth in claim 15, wherein the chromatic coloring material content of the color toner is 1 to 10 parts by weight relative to 100 parts by weight of the binder resin.

17. A magenta toner comprising:

at least a binder resin and a magenta pigment; wherein when a film of the magenta toner is formed on a sheet for an overhead projector, the toner film has a surface gloss of 105 or more and satisfies the following relation (1):

$$(A_{MP}-A_{MB})/A_{MB} \geqq 85 \quad (1)$$

in which $A_{MP}$ denotes maximum absorbance of the toner film in a wave range of 500 to 600 nm, and $A_{MB}$ denotes minimum absorbance in a wave range of 400 to 800 nm.

18. A magenta toner as set forth in claim 17, further containing metal oxide particulate having a BET specific surface area of 20 to 300 $m^2/g$.

19. A magenta toner as set forth in claim 17, wherein a melting viscosity $V_2$ of the binder resin at 100° C. is $5\times10^4$ to $1\times10^6$ poise, and a ratio $V_1/V_2$ of melting viscosity $V_1$ of the binder resin at 90° C. to the melting viscosity $V_2$ is 8 or more.

20. A yellow toner comprising:

at least a binder resin and a yellow pigment; wherein when a film of the yellow toner is formed on a sheet for an overhead projector, the toner film has a surface gloss of 105 or more and satisfies the following relation (2):

$$(A_{YP}-A_{YB})/A_{YB}\geqq 75 \quad (2)$$

in which $A_{YP}$ denotes maximum absorbance of the toner film in a wave range of 380 to 500 nm, and $A_{YB}$ denotes minimum absorbance in a wave range of 400 to 800 nm.

21. A yellow toner as set forth in claim 20, further containing metal oxide particulate having a BET specific surface area of 20 to 300 $m^2/g$.

22. A yellow toner as set forth in claim 20, wherein a melting viscosity $V_2$ of the binder resin at 100° C. is $5\times10^4$ to $1\times10^6$ poise, and a ratio $V_1/V_2$ of melting viscosity $V_1$ of the binder resin at 90° C. to the melting viscosity $V_2$ is 8 or more.

23. A cyan toner comprising:

at least a binder resin and a cyan pigment; wherein when a film of the cyan toner is formed on a sheet for an overhead projector, the toner film has a surface gloss of 105 or more and satisfies the following relation (3):

$$(A_{CP}-A_{CB})/A_{CB}\geqq 45 \quad (3)$$

in which $A_{CP}$ denotes maximum absorbance of the toner film in a wave range of 600 to 800 nm, and $A_{CB}$ denotes minimum absorbance in a wave range of 400 to 800 nm.

24. A cyan toner as set forth in claim 23, further containing metal oxide particulate having a BET specific surface area of 20 to 300 $m^2/g$.

25. A cyan toner as set forth in claim 23, wherein a melting viscosity $V_2$ of the binder resin at 100° C. is $5\times10^4$ to $1\times10^6$ poise, and a ratio $V_1/V_2$ of melting viscosity $V_1$ of the binder resin at 90° C. to the melting viscosity $V_2$ is 8 or more.

* * * * *